US010617149B2

(12) United States Patent
Malgat et al.

(10) Patent No.: US 10,617,149 B2
(45) Date of Patent: Apr. 14, 2020

(54) AEROSOL-GENERATING ARTICLE WITH LOW RESISTANCE AIR FLOW PATH

(71) Applicant: PHILIP MORRIS PRODUCTS S.A., Neuchatel (CH)

(72) Inventors: Alexandre Malgat, Les Tuileries de Grandson (CH); Stephane Roudier, Colombier (CH); Ana Carolina Borges de Couraca, Lausanne (CH); Frederic Lavanchy, Chavornay (CH); Cedric Meyer, Lausanne (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 16 days.

(21) Appl. No.: 15/101,659

(22) PCT Filed: Dec. 4, 2014

(86) PCT No.: PCT/EP2014/076647
§ 371 (c)(1),
(2) Date: Jun. 3, 2016

(87) PCT Pub. No.: WO2015/082649
PCT Pub. Date: Jun. 11, 2015

(65) Prior Publication Data

US 2016/0331032 A1 Nov. 17, 2016

(30) Foreign Application Priority Data

Dec. 5, 2013 (EP) ..... 13195923

(51) Int. Cl.

| | |
|---|---|
| ***A24F 47/00*** | (2020.01) |
| ***A24B 3/14*** | (2006.01) |
| ***H05B 6/10*** | (2006.01) |

(52) U.S. Cl.
CPC ..... *A24F 47/008* (2013.01); *A24B 3/14* (2013.01); *A24F 47/004* (2013.01); *H05B 6/108* (2013.01)

(58) Field of Classification Search
None
See application file for complete search history.

(56) References Cited

U.S. PATENT DOCUMENTS 3,756,250 A * 9/1973 Morgenstern ..... A24D 3/043 131/336
4,564,030 A * 1/1986 Jessup ..... A24D 3/043 131/336

(Continued)

FOREIGN PATENT DOCUMENTS

CN 1126426 A 7/1996
EA 029918 10/2016

(Continued)

OTHER PUBLICATIONS

International Search Report dated Apr. 9, 2015, in PCT/EP2014/076647 filed Dec. 4, 2014.

(Continued)

*Primary Examiner* — Eric Yaary
(74) *Attorney, Agent, or Firm* — Oblon, McClelland, Maier & Neustadt, L.L.P.

(57) ABSTRACT

A heated aerosol-generating article for use with an aerosol-generating device is provided, including a plurality of components including an aerosol-forming substrate assembled within a wrapper to form a rod having a mouth end and a distal end upstream from the mouth end, the heated aerosol-generating article defining a first air-flow path in which air drawn into the aerosol-generating article through the mouth end passes through the aerosol-forming substrate, and a second air-flow path in which air drawn into the aerosol-generating article through the mouth end does not pass (Continued)

through the aerosol-forming substrate, the resistance to draw (RTD) of the second air-flow path being lower than the RTD of the first air-flow path when the heated aerosol-generating article is not coupled to an aerosol-generating device.

11 Claims, 2 Drawing Sheets

(56) References Cited

U.S. PATENT DOCUMENTS

| | | | | |
|---|---|---|---|---|
| 4,807,647 | A | 2/1989 | Hayes | |
| 5,016,656 | A * | 5/1991 | McMurtrie | A24D 1/00 131/360 |
| 5,033,484 | A | 7/1991 | Seidel et al. | |
| 5,058,608 | A * | 10/1991 | Henning | A24D 3/043 131/336 |
| 5,369,723 | A * | 11/1994 | Counts | H05B 3/145 392/386 |
| 5,613,505 | A | 3/1997 | Campbell et al. | |
| 6,443,161 | B1 * | 9/2002 | Kaczmarek | A24C 5/40 131/225 |
| 2003/0154991 | A1 | 8/2003 | Fournier et al. | |
| 2005/0016549 | A1 * | 1/2005 | Banerjee | A24B 15/16 131/194 |
| 2006/0185687 | A1 | 8/2006 | Hearn et al. | |
| 2008/0092912 | A1 * | 4/2008 | Robinson | A24B 13/02 131/200 |
| 2011/0271972 | A1 * | 11/2011 | Thomas | A24B 15/165 131/365 |
| 2014/0158144 | A1 * | 6/2014 | Kaljura | A24D 3/043 131/280 |
| 2014/0187881 | A1 | 7/2014 | Saito et al. | |
| 2014/0305448 | A1 | 10/2014 | Zuber et al. | |

FOREIGN PATENT DOCUMENTS

| | | | | |
|---|---|---|---|---|
| EP | 1754419 | A1 * | 2/2007 | A24D 3/048 |
| EP | 1 889 550 | B1 | 7/2009 | |
| JP | 8-505051 | A | 6/1996 | |
| JP | 8-511176 | A | 11/1996 | |
| JP | 3015466 | | 12/1999 | |
| JP | 2008-35861 | A | 2/2008 | |
| JP | 2009-509521 | A | 3/2009 | |
| JP | 4740506 | | 5/2011 | |
| RU | 2014132076 | | 2/2016 | |
| RU | 2600915 | | 10/2016 | |
| WO | WO 94/14346 | A1 | 7/1994 | |
| WO | WO 95/27411 | A1 | 10/1995 | |
| WO | WO 2006/067627 | A1 | 6/2006 | |
| WO | WO 2007/039794 | A2 | 4/2007 | |
| WO | WO 2012/164009 | A2 | 12/2012 | |
| WO | WO 2013/011300 | A2 | 1/2013 | |
| WO | WO 2013/098405 | A2 | 7/2013 | |
| WO | WO 2013/102614 | A2 | 7/2013 | |
| WO | WO 2015/082649 | A1 | 6/2015 | |

OTHER PUBLICATIONS

Written Opinion of the International Searching Authority dated Apr. 9, 2015, in PCT/EP20141076647 filed Dec. 4, 2014.

Office Action dated Sep. 18, 2018 in Japanese Patent Application No. 2016-530201. citing document AO therein, 7 pages (submitting English translation only).

Combined Chinese Office Action and Search Report dated Jul. 6, 2018 in Chinese Patent Application No. 201480062127.4 (submitting English translation only), citing documents AO and AP therein, 20 pages.

Australian Office Action dated Jun. 13, 2018 in Australian Patent Application No. 2014359184, citing documents AA and AO therein, 4 pages.

Office Action dated Apr. 16, 2019 in Eurasian Patent Application No. 201690843 citing documents AO-AQ therein.

"Determination of Ventilation—Definitions and Measurement Principles" Coresta Recommended Method N° 6, 2000, 9 pages.

"Tobacco and tobacco products—Draw resistance of cigarettes and pressure drop of filter rods—Standard conditions and measurement" International Standard ISO 6565, Third edition, 2002, 9 pages.

* cited by examiner

AEROSOL-GENERATING ARTICLE WITH LOW RESISTANCE AIR FLOW PATH

The present specification relates to an aerosol-generating article comprising an aerosol-forming substrate for generating an inhalable aerosol when heated using an aerosol-generating device. When not engaged by an aerosol-generating device, the aerosol-generating article defines a low resistance air-flow path that does not pass through the aerosol-forming substrate. The specification also relates to a method of using such an aerosol-generating article.

Aerosol-generating articles in which an aerosol-forming substrate, such as a tobacco containing substrate, is heated rather than combusted are known in the art. The aim of such heated aerosol-generating articles is to reduce known harmful smoke constituents produced by the combustion and pyrolytic degradation of tobacco in conventional cigarettes.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast in heated aerosol-generating articles, an inhalable aerosol is typically generated by the transfer of heat from a heat source to a physically separate aerosol-forming substrate or material, which may be located within, around or downstream of the heat source. During consumption, volatile compounds are released from the aerosol-forming substrate by heat transfer from the heat source and entrained in air drawn through the aerosol-generating article. As the released compounds cool, they condense to form an aerosol that is inhaled by the consumer.

Heated aerosol-generating articles comprising tobacco for generation of an aerosol by heating rather than burning are known in the art. For example, WO2013/102614 discloses an aerosol-generating system comprising a heated aerosol-generating article and an aerosol-generating device having a heater for heating the heated aerosol-generating article to produce an aerosol.

Tobacco used as part of an aerosol-forming substrate in heated aerosol-generating articles is designed to produce an aerosol when heated rather than when burned. Thus, such tobacco typically contains high levels of aerosol formers, such as glycerine or propylene glycol. If a user were to light a heated aerosol-generating article and smoke it as if it were a conventional cigarette that user would not receive the intended user experience. It would be desirable to produce a heated aerosol-generating article that has a lowered or no propensity for flame ignition. Such a heated aerosol-generating article would be preferably difficult to light during attempts to light the article with a lighter, such as a flame, in the manner of traditional cigarettes.

A heated aerosol-generating article may be provided for use with an aerosol-generating device. The heated aerosol-generating article may comprise a plurality of components, including an aerosol-forming substrate, assembled within a wrapper to form a rod having a mouth end and a distal end upstream from the mouth end. The heated aerosol-generating article defines a first potential air-flow path in which air drawn into the aerosol-generating article through the mouth end does passes through the aerosol-forming substrate, and a second potential air-flow path in which air drawn into the aerosol-generating article through the mouth end does not pass through the aerosol-forming substrate. The resistance to draw (RTD) of the second air-flow path is lower than the RTD of the first air-flow path when the heated aerosol-generating article is not coupled to an aerosol-generating device. The second air-flow path is of low resistance compared with the first air-flow path.

When the heated aerosol-generating article is not coupled to an aerosol-generating device, the preferred air-flow path for air drawn into the heated aerosol-generating article through the mouth end is the second air-flow path. Thus, if a user draws on the mouth end of the heated aerosol-generating article without engaging the heated aerosol-generating article with an aerosol-generating device, substantially no air is drawn through the aerosol-forming substrate. If a user attempts to light the heated aerosol-generating article in the same manner as a traditional cigarette, i.e. by holding a flame to the distal end of the rod and drawing through the mouth end, substantially no air will flow through the aerosol-forming substrate. This lack of air flow makes it difficult to ignite the aerosol-forming substrate.

The heated aerosol-generating article may have a low effective resistance to draw (RTD) when not coupled to an aerosol-generating device. For example, the effective RTD may be close to zero. This may prevent a user from drawing air through the aerosol-forming substrate sufficiently to light the aerosol-forming substrate. The second air-flow path may be any air-flow path that prevents sufficient air-flow through the aerosol-forming substrate to inhibit self-sustained combustion of the substrate during attempted lighting of the article.

Preferably, the interaction between the heated aerosol-generating article and an aerosol-generating device increases the RTD along the second air-flow path such that air flow along the first air-flow path is favoured. Engagement of the heated aerosol generating article and the aerosol-generating device may partially or completely block the second air-flow path such that the second air flow path is of higher resistance than the first air flow path. Air drawn through the heated aerosol-generating article may, therefore, flow preferentially along the first air-flow path through the aerosol-forming substrate.

The aerosol-forming substrate of the heated aerosol-generating article may be located at, or towards, the distal end of the rod. One or more holes or perforations defined through the wrapper downstream of the aerosol-forming substrate may define part of the second air-flow path. Thus, the air-flow path of least resistance, when the heated aerosol-generating article is not engaged with an aerosol-generating device, is into the article through holes or perforations in the wrapper downstream of the aerosol-forming substrate. The air that flows into the article through this route is then drawn through the mouth end of the rod and does not pass over or through the aerosol-forming substrate.

It may be preferred that the wrapper is a highly perforated wrapper allowing air to be drawn into the heated aerosol-generating article through the wrapper downstream of the aerosol-forming substrate. A perforated wrapper may reduce the RTD of the heated aerosol-generating article to almost zero.

A support element, such as a hollow acetate tube, may be located downstream of the aerosol-forming substrate. A radially extending hole may be defined through a radial wall of the support element forming part of the second air-flow path. Such a hole is preferably large enough to reduce the RTD of the heated aerosol-generating article to almost zero. The wrapper may define a hole that overlaps with the radially extending hole. Alternatively, the wrapper may be a highly perforated wrapper.

In preferred embodiments the aerosol-forming substrate is in the form of an aerosol-generating rod comprising at least one gathered sheet of material. The gathered sheet of material may be a sheet of homogenised tobacco. The aerosol-forming substrate may be a rod of gathered tobacco as described in WO 2012/164009.

A heated aerosol-generating system may comprise a heated aerosol-generating article according to any embodiment described above, and an aerosol-generating device comprising means for heating the aerosol-forming substrate. The aerosol-generating device is arranged to engage with the heated aerosol-generating article such that the second air flow path is disrupted to allow air to be drawn through the aerosol-forming substrate when a user draws on the mouth end of the rod.

Preferably, engagement of the heated aerosol-generating device with the aerosol-generating article causes an increase in the resistance along the second air-flow path. Thus, the preferred air-flow path becomes the first air-flow path through the aerosol-forming substrate.

The aerosol-generating device may define a chamber for receiving the aerosol-generating article. The chamber may seal at least a portion of an outer surface of the aerosol-generating article sufficiently to increase the resistance to, or entirely prevent, air flow along the second air-flow path. The device allows air to pass through the aerosol-forming substrate when the heated aerosol-generating article is engaged with the aerosol-generating device. The aerosol-generating device may interact with the aerosol-generating article to seal one or more air-flow holes or perforations defined in the aerosol-generating article.

The aerosol-generating device includes a means for heating the aerosol-forming substrate of the aerosol-generating article. Such means may comprise a heating element, for example a heating element that is insertable into the aerosol-generating article or a heating element that can be disposed adjacent to an aerosol-generating article. The heating means may comprise an inductor, for example an induction coil, for interacting with a susceptor.

A method of smoking or consuming an aerosol-generating article as described herein may comprise the steps of engaging the heated aerosol-generating article with an aerosol-generating device such that the second air-flow path is disrupted, actuating the aerosol-generating device to heat the aerosol-forming substrate, and drawing on the mouth end of the rod to cause air to flow along the first air-flow path, an aerosol generated by heating of the aerosol-forming substrate being entrained in the air as it passes through the aerosol-forming substrate.

As used herein, the term 'aerosol-forming substrate' is used to describe a substrate capable of releasing upon heating volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

As used herein, the terms 'upstream' and 'downstream' are used to describe the relative positions of elements, or portions of elements, of the heated aerosol-generating article in relation to the direction in which a user draws on the aerosol-generating article during use thereof.

The heated aerosol-generating article comprises two ends: a proximal end through which aerosol exits the aerosol-generating article and is delivered to a user and a distal end. In use, a user may draw on the proximal end in order to inhale aerosol generated by the aerosol-generating article.

The proximal end may also be referred to as the mouth end or the downstream end and is downstream of the distal end. The distal end may also be referred to as the upstream end and is upstream of the proximal end.

As used herein, the term 'aerosol-cooling element' is used to describe an element having a large surface area and a low resistance to draw. In use, an aerosol formed by volatile compounds released from the aerosol-forming substrate passes over and is cooled by the aerosol-cooling element before being inhaled by a user. In contrast to high resistance to draw filters and other mouthpieces, aerosol-cooling elements have a low resistance to draw. Chambers and cavities within an aerosol-generating article are also not considered to be aerosol cooling elements.

Preferably, the heated aerosol-generating article is a smoking article that generates an aerosol that is directly inhalable into a user's lungs through the user's mouth. More, preferably, the heated aerosol-generating article is a smoking article that generates a nicotine-containing aerosol that is directly inhalable into a user's lungs through the user's mouth.

As used herein, the term 'aerosol-generating device' is used to describe a device that interacts with an aerosol-forming substrate of an aerosol-generating article to generate an aerosol. Preferably, the aerosol-generating device is a smoking device that interacts with an aerosol-forming substrate of a heated aerosol-generating article to generate an aerosol that is directly inhalable into a user's lungs thorough the user's mouth. Preferably, the aerosol-generating device interacts with an aerosol-generating article to allow air to flow through the aerosol-forming substrate.

For the avoidance of doubt, in the following description the term 'heating element' is used to mean one or more heating elements.

In preferred embodiments, the aerosol-forming substrate is located at the upstream end of the aerosol-generating article.

As used herein, the term 'diameter' is used to describe the maximum dimension in the transverse direction of the aerosol-generating article. As used herein, the term 'length' is used to describe the maximum dimension in the longitudinal direction of the aerosol-generating article.

Preferably, the aerosol-forming substrate is a solid aerosol-forming substrate. The aerosol-forming substrate may comprise both solid and liquid components.

Preferably, the aerosol-forming substrate comprises nicotine. More preferably, the aerosol-forming substrate comprises tobacco.

Alternatively or in addition, the aerosol-forming substrate may comprise a non-tobacco containing aerosol-forming material.

If the aerosol-forming substrate is a solid aerosol-forming substrate, the solid aerosol-forming substrate may comprise, for example, one or more of: powder, granules, pellets, shreds, strands, strips or sheets containing one or more of: herb leaf, tobacco leaf, tobacco ribs, expanded tobacco and homogenised tobacco.

Optionally, the solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In a preferred embodiment, the aerosol-forming substrate comprises homogenised tobacco material.

As used herein, the term 'homogenised tobacco material' denotes a material formed by agglomerating particulate tobacco.

Preferably, the aerosol-forming substrate comprises a gathered sheet of homogenised tobacco material.

As used herein, the term 'sheet' denotes a laminar element having a width and length substantially greater than the thickness thereof.

As used herein, the term 'gathered' is used to describe a sheet that is convoluted, folded, or otherwise compressed or constricted substantially transversely to the longitudinal axis of the aerosol-generating article.

Use of an aerosol-forming substrate comprising a gathered sheet of homogenised tobacco material advantageously significantly reduces the risk of 'loose ends' compared to an aerosol-forming substrate comprising shreds of tobacco material, that is the loss of shreds of tobacco material from the ends of the rod. Loose ends may disadvantageously lead to the need for more frequent cleaning of an aerosol-generating device for use with the aerosol-generating article and manufacturing equipment.

In a preferred embodiment, the aerosol-forming substrate comprises a gathered textured sheet of homogenised tobacco material.

As used herein, the term 'textured sheet' denotes a sheet that has been crimped, embossed, debossed, perforated or otherwise deformed. The aerosol-forming substrate may comprise a gathered textured sheet of homogenised tobacco material comprising a plurality of spaced-apart indentations, protrusions, perforations or a combination thereof.

In a particularly preferred embodiment, the aerosol-forming substrate comprises a gathered crimpled sheet of homogenised tobacco material.

Use of a textured sheet of homogenised tobacco material may advantageously facilitate gathering of the sheet of homogenised tobacco material to form the aerosol-forming substrate.

As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled.

In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

The aerosol-forming substrate may be in the form of a plug comprising an aerosol-forming material circumscribed by a paper or other wrapper. Where an aerosol-forming substrate is in the form of a plug, the entire plug including any wrapper is considered to be the aerosol-forming substrate.

In a preferred embodiment, the aerosol-generating substrate comprises a plug comprising a gathered textured sheet of homogenised tobacco material circumscribed by a wrapper. In a particularly preferred embodiment, the aerosol-generating substrate comprises a plug comprising a gathered crimped sheet of homogenised tobacco material circumscribed by a wrapper.

In certain embodiments, sheets of homogenised tobacco material for use in the aerosol-generating substrate may have a tobacco content of approximately 70% or more by weight on a dry weight basis.

Sheets of homogenised tobacco material for use in the aerosol-generating substrate may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-generating substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material for use in the aerosol-generating substrate are known in the art and include, but are not limited to: gums such as, for example, guar gum, xanthan gum, arabic gum and locust bean gum; cellulosic hinders such as, for example, hydroxypropyl cellulose, carboxymethyl cellulose. hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets of homogenised tobacco material for use in the aerosol-generating substrate are known in the art and include, but are not limited to: cellulose fibres; soft-wood fibres; hard-wood fibres; jute fibres and combinations thereof. Prior to inclusion in sheets of homogenised tobacco material for use in the aerosol-generating substrate, non-tobacco fibres may be treated by suitable processes known in the art including, but not limited to: mechanical pulping; refining; chemical pulping; bleaching; sulphate pulping; and combinations thereof.

Sheets of homogenised tobacco material for use in the aerosol-generating substrate should have sufficiently high tensile strength to survive being gathered to form the aerosol-generating substrate. In certain embodiments non-tobacco fibres may be included in sheets of homogenised tobacco material for use in the aerosol-generating substrate in order to achieve an appropriate tensile strength.

For example, homogenised sheets of tobacco material for use in the aerosol-generating substrate may comprise between approximately 1% and approximately 5% non-tobacco fibres by weight on a dry weight basis.

Preferably, the aerosol-forming substrate comprises an aerosol former.

As used herein, the term 'aerosol former' is used to describe any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

Preferably, the aerosol-forming substrate has an aerosol former content of greater than 5% on a dry weight basis.

The aerosol aerosol-forming substrate may have an aerosol former content of between approximately 5% and approximately 30% on a dry weight basis.

In a preferred embodiment, the aerosol-forming substrate has an aerosol former content of approximately 20% on a dry weight basis.

Aerosol-forming substrates comprising gathered sheets of homogenised tobacco for use in the aerosol-generating article may be made by methods known in the art, for example the methods disclosed in WO 2012/164009 A2.

In a preferred embodiment sheets of homogenised tobacco material for use in the aerosol-generating article are formed from a slurry comprising particulate tobacco, guar gum, cellulose fibres and glycerine by a casting process.

The aerosol-forming element preferably has an external diameter that is approximately equal to the external diameter of the aerosol-generating article.

Preferably, the aerosol-forming substrate has an external diameter of at least 5 millimetres. The aerosol-forming substrate may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the aerosol-forming substrate has an external diameter of 7.2 millimetres +/−10%.

The aerosol-forming substrate may have a length of between approximately 7 millimetres and approximately 15 mm. In one embodiment, the aerosol-forming substrate may have a length of approximately 10 millimetres. In a preferred embodiment, the aerosol-forming substrate has a length of approximately 12 millimetres.

Preferably, the aerosol-forming substrate is substantially cylindrical.

A support element, for example a hollow support element, may be located immediately downstream of the aerosol-forming substrate.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate.

The support element may comprise a hollow tubular element. In a preferred embodiment, the support element comprises a hollow cellulose acetate tube.

The support element preferably has an external diameter that is approximately equal to the external diameter of the aerosol-generating article.

The support element may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the support element has an external diameter of 7.2 millimetres +/−10%.

The support element may have a length of between approximately 5 millimetres and approximately 15 mm. In a preferred embodiment, the support element has a length of approximately 8 millimetres.

An aerosol-cooling element may be located downstream of the aerosol-forming substrate. For example, in some embodiments an aerosol-cooling element may be located immediately downstream of a support element downstream of the aerosol-forming substrate.

The aerosol-cooling element may be located between a support element and a mouthpiece located at the extreme downstream end of the aerosol-generating article.

The aerosol-cooling element may have a total surface area of between approximately 300 square millimetres per millimetre length and approximately 1000 square millimetres per millimetre length. In a preferred embodiment, the aerosol-cooling element has a total surface area of approximately 500 square millimetres per millimetre length.

The aerosol-cooling element may be alternatively termed a heat exchanger.

The aerosol-cooling element preferably has a low resistance to draw. That is, the aerosol-cooling element preferably offers a low resistance to the passage of air through the aerosol-generating article. Preferably, the aerosol-cooling element does not substantially affect the resistance to draw of the aerosol-generating article.

Preferably, the aerosol-cooling element has a porosity of between 50% and 90% in the longitudinal direction. The porosity of the aerosol-cooling element in the longitudinal direction is defined by the ratio of the cross-sectional area of material forming the aerosol-cooling element and the internal cross-sectional area of the aerosol-generating article at the position of the aerosol-cooling element.

The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. Alternatively, the plurality of longitudinally extending channels may be defined by multiple sheets that have been one or more of crimped, pleated, gathered and folded to form multiple channels.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

The aerosol-cooling element may have an external diameter of a diameter of between approximately 5 millimetres and approximately 10 millimetres, for example of between approximately 6 millimetres and approximately 8 millimetres. In a preferred embodiment, the aerosol-cooling element has an external diameter of 7.2 millimetres +/−10%.

The aerosol-cooling element may have a length of between approximately 5 millimetres and approximately 25 mm. In a preferred embodiment, the aerosol-cooling element has a length of approximately 18 millimetres.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In a preferred embodiment, the aerosol-cooling element comprises a gathered sheet of biodegradable polymeric material, such as polylactic acid or a grade of Mater-Bi® (a commercially available family of starch based copolyesters).

In a particularly preferred embodiment, the aerosol-cooling element comprises a gathered sheet of polylactic acid.

The aerosol-generating article may comprise a mouthpiece located at the downstream end of the aerosol-generating article.

The mouthpiece may be located immediately downstream of the aerosol-cooling element and abut the aerosol-cooling element.

The mouthpiece may comprise a filter. The filter may be formed from one or more suitable filtration materials. Many such filtration materials are known in the art. In one embodiment, the mouthpiece may comprise a filter formed from cellulose acetate tow.

The mouthpiece preferably has an external diameter that is approximately equal to the external diameter of the aerosol-generating article.

The mouthpiece may have an external diameter of a diameter of between approximately 5 millimetres and approximately 10 millimetres, for example of between approximately 6 millimetres and approximately 8 millimetres. In a preferred embodiment, the mouthpiece has an external diameter of 7.2 millimetres +/−10%.

The mouthpiece may have a length of between approximately 5 millimetres and approximately 20 millimetres. In a preferred embodiment, the mouthpiece has a length of approximately 14 millimetres.

The mouthpiece may have a length of between approximately 5 millimetres and approximately 14 millimetres. In a preferred embodiment, the mouthpiece has a length of approximately 7 millimetres.

The aerosol-forming substrate, and any other components of the heated aerosol-generating article are assembled within a circumscribing wrapper. The wrapper may be formed from any suitable material or combination of materials. Preferably, the outer wrapper is a cigarette paper.

A downstream end portion of the wrapper may be circumscribed by a band of tipping paper.

The appearance of the heated aerosol-generating article may simulate the appearance of a conventional lit-end cigarette.

The aerosol-generating article may have an external diameter of between approximately 5 millimetres and approximately 12 millimetres, for example of between approximately 6 millimetres and approximately 8 millimetres. In a preferred embodiment, the aerosol-generating article has an external diameter of 7.2 millimetres +/−10%.

The aerosol-generating article may have a total length of between approximately 30 millimetres and approximately 100 millimetres. In a preferred embodiment, the aerosol-generating article has a total length of approximately 45 millimetres.

The aerosol-generating device may comprise: a housing; a heating element; an electrical power supply connected to the heating element; and a control element configured to control the supply of power from the power supply to the heating element.

The housing may define a cavity surrounding the heating element, the cavity configured to receive the heated aerosol-generating article and interact with the aerosol-generating article to disrupt or close the second air-flow path and allow air to be drawn through the aerosol-forming substrate.

Preferably, the aerosol-generating device is a portable or handheld aerosol-generating device that is comfortable for a user to hold between the fingers of a single hand.

The aerosol-generating device may be substantially cylindrical in shape

The aerosol-generating device may have a length of between approximately 70 millimetres and approximately 120 millimetres.

The power supply may be any suitable power supply, for example a DC voltage source such as a battery. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

The control element may be a simple switch. Alternatively the control element may be electric circuitry and may comprise one or more microprocessors or microcontrollers.

The heating element of the aerosol-generating device may be any suitable heating element capable of being inserted into the aerosol-forming substrate of the aerosol-generating article. For example, the heating element may be in the form of a pin or blade.

The heating element may have a tapered, pointed or sharpened end to facilitate insertion of the heating element into the aerosol-forming substrate of the aerosol-generating article.

The resistance to draw (RTD) of the aerosol-generating article before engagement with the aerosol-generating article is preferably close to zero, for example lower than 10 mm WG. Preferably, the RTD after engagement with the aerosol-generating device may be between approximately 80 mm WG and approximately 140 mm WG, and is preferably between 110 and 115 mm WG.

As used herein, resistance to draw is expressed with the units of pressure 'mm WG' or 'mm of water gauge' and is measured in accordance with ISO 6565:2002.

In another aspect, there is provided a heated aerosol-generating article for use with an aerosol-generating device, the heated aerosol-generating article comprising a plurality of components including an aerosol-forming substrate assembled within a wrapper to form a rod having a mouth end and a distal end upstream from the mouth end, the heated aerosol-generating article defining a first air-flow path in which air drawn into the aerosol-generating article through the mouth end passes through the aerosol-forming substrate, and a second air-flow path in which air drawn into the aerosol-generating article through the mouth end is drawn into the rod through the wrapper, wherein the second air-flow paths joins the first air-flow path at a position downstream of the aerosol-forming substrate, the resistance to draw (RTD) of the second air-flow path through the wrapper being lower than the RTD of the first air-flow path through the aerosol-forming substrate.

Preferably, the RTD of second air-flow path is no more than 0.9 times the RTD of the first air-flow path, more preferably between 0.2 and 0.7 times the RTD of the first air-flow path, and even more preferably between 0.3 and 0.5 times the RTD of the first air-flow path.

In a further aspect, there is provided a heated aerosol-generating article for use with an aerosol-generating device, the heated aerosol-generating article comprising a plurality of components including an aerosol-forming substrate assembled within a wrapper to form a rod having a mouth end and a distal end upstream from the mouth end, the heated aerosol-generating article defining a first air-flow path in which air drawn into the aerosol-generating article through the mouth end passes through the aerosol-forming substrate, and a second air-flow path in which air is drawn into the aerosol-generating article through the mouth end is drawn into the rod through the wrapper, wherein the second air-flow path joins the first air-flow path at a position downstream of the aerosol-forming substrate, and wherein the aerosol-generating article is constructed so that, when suction is applied to the mouth end of the rod and neither the first or the second airflow path is blocked, a greater volume of air is drawn through the second air-flow path than is drawn through the first air-flow path.

The volume of air drawn through the second air-flow path is preferably at least twice the volume of air drawn through the first air-flow path.

Features described in relation to one aspect or embodiment may also be applicable to other aspects and embodiments. For example, features described in relation to aerosol-generating articles and aerosol-generating systems described above may also be used in conjunction with methods of using aerosol-generating articles and aerosol-generating systems described above.

Specific embodiments will now be described with reference to the figures, in which.

Figure 1:
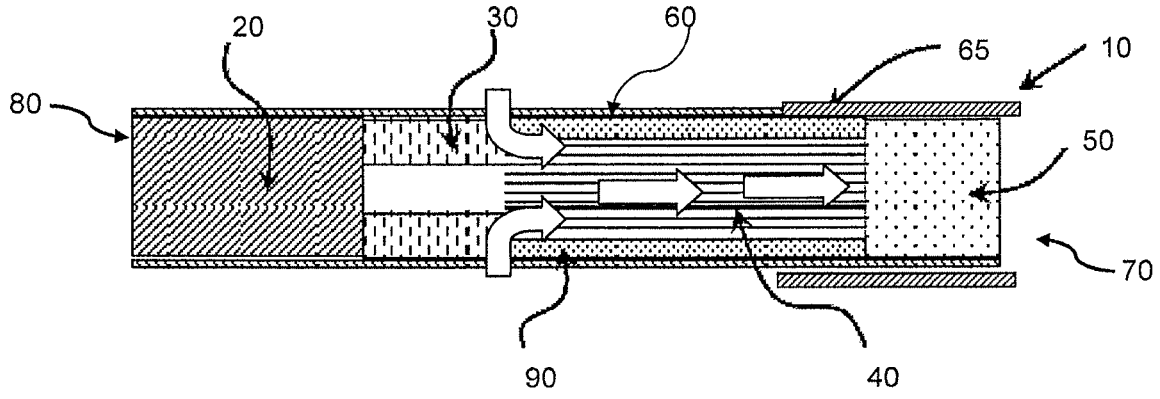
FIG. 1 is a schematic cross-sectional diagram of an embodiment of a heated aerosol-generating article for use with an aerosol generating-device.

FIG. 1 illustrates a heated aerosol-generating article 10 according to a preferred embodiment. The aerosol-generating article 10 comprises four elements arranged in coaxial alignment: an aerosol-forming substrate 20, a support element 30, an aerosol-cooling element 40, and a mouthpiece 50. These four elements are arranged sequentially and are circumscribed by an outer wrapper 60 to form the heated aerosol-generating article 10. The aerosol-generating 10 has a proximal or mouth end 70, which a user inserts into his or her mouth during use, and a distal end 80 located at the opposite end of the aerosol-generating article 10 to the mouth end 70. The outer wrapper 60 is a highly perforated paper that provides little or no resistance to air-flow through the paper. A non-perforated tipping paper 65 circumscribes the mouthpiece end of the article 10.

The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or, alternatively, downstream of the distal end 80.

The aerosol-forming substrate 20 is located at the extreme distal or upstream end of the aerosol-generating article 10. In the embodiment illustrated in FIG. 1, aerosol-forming substrate 20 comprises a gathered sheet of crimped homogenised tobacco material circumscribed by a wrapper. The crimped sheet of homogenised tobacco material comprises glycerine as an aerosol-former.

The support element 30 is located immediately downstream of the aerosol-forming substrate 20 and abuts the aerosol-forming substrate 20. In the embodiment shown in FIG. 1, the support element is a hollow cellulose acetate tube. The support element 30 locates the aerosol-forming substrate 20 at the extreme distal end 80 of the aerosol-generating article 10 so that it can be penetrated by a heating element of an aerosol-generating device. The support element 30 also acts to prevent the aerosol-forming substrate 20 from being forced downstream within the aerosol-generating article 10 towards the aerosol-cooling element 40 when a heating element of an aerosol-generating device is inserted into the aerosol-forming substrate 20. The support element 30 also acts as a spacer to space the aerosol-cooling element 40 of the aerosol-generating article 10 from the aerosol-forming substrate 20.

The aerosol-cooling element 40 is located immediately downstream of the support element 30 and abuts the support element 30. In use, volatile substances released from the aerosol-forming substrate 20 pass along the aerosol-cooling element 40 towards the mouth end 70 of the aerosol-generating article 10. The volatile substances may cool within the aerosol-cooling element 40 to form an aerosol that is inhaled by the user. In the embodiment illustrated in FIG. 1, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In the embodiment illustrated in FIG. 1, the mouthpiece 50 comprises a conventional cellulose acetate tow filter of low filtration efficiency.

To assemble the aerosol-generating article 10, the four elements described above are aligned and tightly wrapped within the perforated outer wrapper 60. In the embodiment illustrated in FIG. 1, a distal end portion of the outer wrapper 60 of the aerosol-generating article 10 is circumscribed by a band of non-perforated tipping paper 65.

If a user draws air through the mouthpiece of the device without engaging the heated aerosol generating article with an aerosol-generating device, there is little resistance to draw. Air enters the article 10 through the perforated outer wrapper 60, as indicated by the arrows on FIG. 1. Because air can flow through the wrapper more easily than it can flow through the aerosol-forming substrate, there is substantially no air flow through the aerosol-forming substrate. Thus, if the user attempts to light the heated aerosol-generating article by applying a flame to the distal end 80 and drawing on the mouth end 70, there will be insufficient air-flow through the aerosol-forming substrate to easily sustain combustion and the risk of ignition will be minimised.

Figure 2:
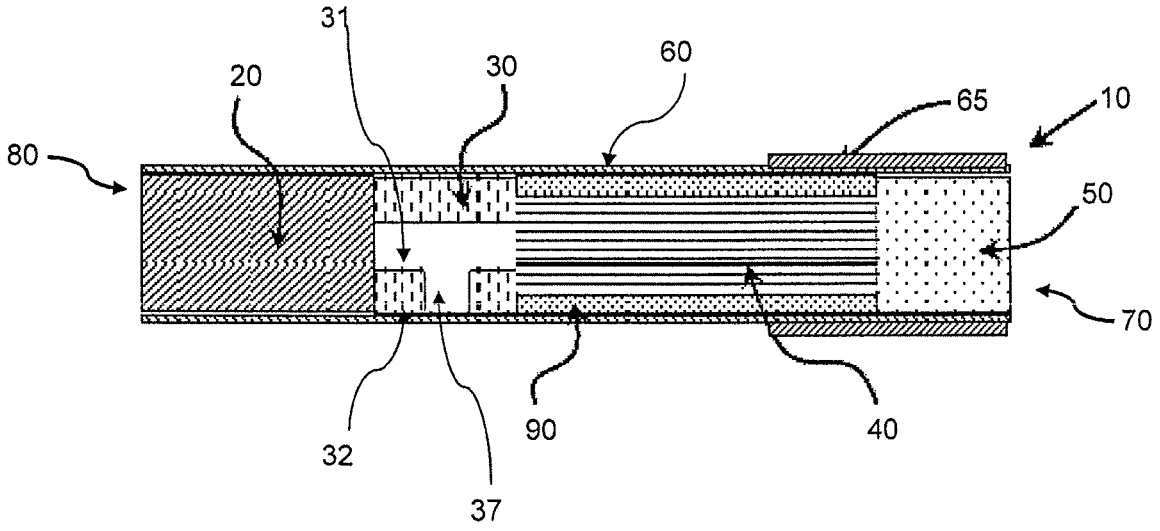
FIG. 2 is a schematic cross-sectional diagram of a further embodiment of a heated aerosol-generating article for use with an aerosol generating-device.

FIG. 2 illustrates a second embodiment of a heated aerosol-generating article. All elements are as described in FIG. 1, with the exception that the support element 30 is a hollow tube that defines a radially-extending hole 37 between an inner surface of the tube 31 and an outer surface of the tube 32. The hole provides an additional air flow path allowing access between inner portions of the aerosol-generating article and the perforated wrapper 60. Thus, the RTD of the article illustrated in FIG. 2 may be even lower than that illustrated in FIG. 1.

The relative volumes of airflow through the aerosol-forming substrate and through the perforated wrapper depend on a number of parameters.

The airflow through the aerosol-forming substrate can be estimated using Darcy's law for flow through a porous body. The volumetric airflow $Q_p$ through the aerosol-forming substrate can be calculated as follows:

$$\frac{Q_p}{A_p} = \frac{K_p}{\mu}\frac{(\Delta P)_p}{L_p}$$

Where $A_p$ is cross-sectional area of the aerosol-forming substrate, $K_p$ is the permeability of the aerosol-forming substrate, $\mu$ is the dynamic viscosity of air, $(\Delta P)_p$ is the pressure drop across the aerosol-forming substrate, and $L_p$ is the length of the aerosol-forming substrate in the direction of air flow.

The volumetric airflow through one perforation in the wrapper can be approximated using the Hagen-Poiseuille equation for laminar fluid flow.

$$(\Delta P)_v = \frac{128\mu t_v Q_{v,i}}{\pi d_v^4}$$

Where $(\Delta P)_v$ is the pressure drop across the perforation, $\mu$ is the dynamic viscosity of air, $t_v$ is the thickness of the wrapper $Q_{v,i}$ is the volumetric airflow through one perforation, and $d_v$ is the diameter of the perforation.

If there are n perforations, then the total volumetric flow rate through all the perforations is:

$$Q_v = n.Q_{v,i} = \frac{(\Delta P)_v \pi n d_v^4}{128\mu t_v}$$

So the ration of the airflow through the first air-flow path and through the second air-flow path is:

$$R = \frac{Q_v}{Q_p} = \frac{(\Delta P)_v \pi n d_v^4}{128\mu t_v}\frac{\mu L_p}{(\Delta P)_p K_p A_p}$$

If $(\Delta P)_p$ is assumed to be equal to $(\Delta P)_v$, then this can be simplified to:

$$R = \frac{\pi n d_v^4 L_p}{128 t_v K_p A_p}$$

So it can be seen that it is both the size and number of perforations and the size and shape of the aerosol-forming substrate and wrapper that are important. The permeability of the plug is also an important factor and that depend on the porosity of the aerosol-forming substrate and the thickness of the crimped tobacco sheets used.

By varying these parameters a desired ratio of airflow through the wrapper and through the plug can be obtained. For example, increasing the size or number of perforations in the wrapper will lower the RTD through the wrapper. Increasing the length of the aerosol-forming substrate will increase the RTD through the aerosol-forming substrate.

The aerosol-generating article 10 illustrated in FIG. 1 or FIG. 2 is designed to engage with an aerosol-generating device comprising a heating element in order to be smoked or consumed by a user. In use, the heating element of the aerosol-generating device heats the aerosol-forming substrate 20 of the aerosol-generating article 10 to a sufficient temperature to form an aerosol, which is drawn downstream through the aerosol-generating article 10 and inhaled by the user.

Figure 3:
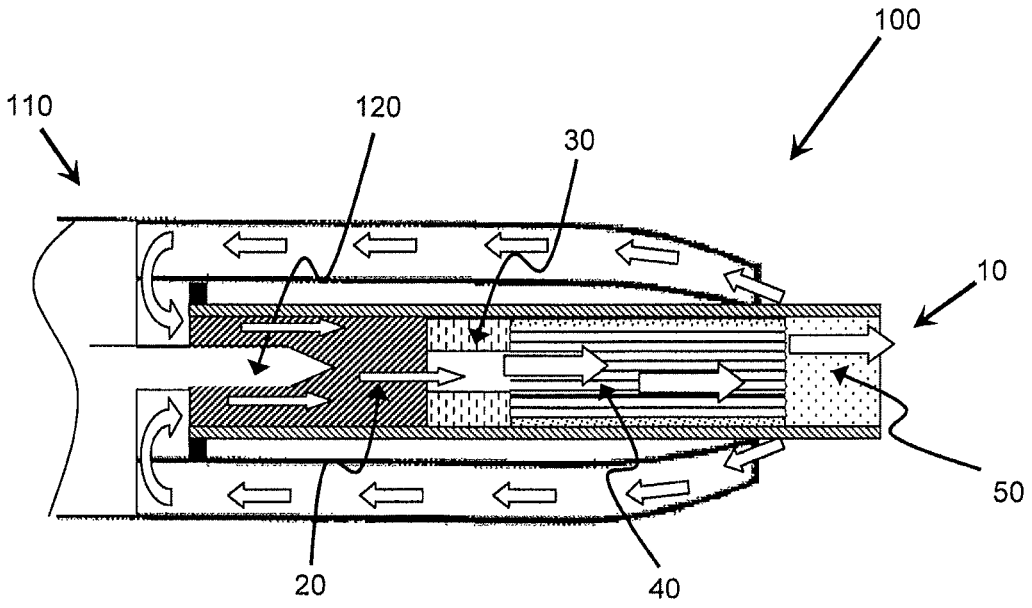
FIG. 3 is a schematic cross-sectional diagram of an embodiment of an aerosol-generating system comprising an electrically heated aerosol-generating device comprising a heating element and an aerosol-generating article according to the embodiment illustrated in FIG. 1.

FIG. 3 illustrates a portion of an aerosol-generating system 100 comprising an aerosol-generating device 110 and an aerosol-generating article 10 according to the embodiment described above and illustrated in FIG. 1.

The aerosol-generating device comprises a heating element 120. As shown in FIG. 3, the heating element 120 is mounted within an aerosol-generating article receiving chamber of the aerosol-generating device 110. In use, the user inserts the aerosol-generating article 10 into the aerosol-generating article receiving chamber of the aerosol-generating device 110 such that the heating element 120 is directly inserted into the aerosol-forming substrate 20 of the aerosol-generating article 10 as shown in FIG. 3. In the embodiment shown in FIG. 3, the heating element 120 of the aerosol-generating device 110 is a heater blade. The aerosol-generating device 110 comprises a power supply and electronics that allow the heating element 120 to be actuated. Such actuation may be manually operated or may occur automatically in response to a user drawing on an aerosol-generating article 10 inserted into the aerosol-generating article receiving chamber of the aerosol-generating device 110.

When the heated aerosol-generating article 10 is engaged correctly with the aerosol-generating device a lip of the receiving chamber engages with an outer surface of the article 10. The circumferential engagement between the article and the lip substantially prevents air-flow into the receiving chamber, and therefore substantially restricts air-flow into the receiving chamber. A plurality of openings is provided in the aerosol-generating device to allow air to flow to the distal end of the aerosol-generating article 10. Thus, when a user draws on the mouth end of the article, the air-flow path of least resistance is the one in which air flows through the distal end of the article and through the aerosol-generating substrate; the direction of this air flow is illustrated by arrows in FIG. 3.

The support element 30 of the aerosol-generating article 10 resists the penetration force experienced by the aerosol-generating article 10 during insertion of the heating element 120 of the aerosol-generating device 110 into the aerosol-forming substrate 20. The support element 30 of the aerosol-generating article 10 thereby resists downstream movement of the aerosol-forming substrate within the aerosol-generating article 10 during insertion of the heating element of the aerosol-generating device into the aerosol-forming substrate.

Once the internal heating element 120 is inserted into the aerosol-forming substrate 10 actuated of the aerosol-generating article 10 and actuated, the aerosol-forming substrate 20 of the aerosol-generating article 10 is heated to a temperature of approximately 375 degrees Celsius by the heating element 120 of the aerosol-generating device 110. At this temperature, volatile compounds are evolved from the aerosol-forming substrate 20 of the aerosol-generating article 10. As a user draws on the mouth end 70 of the aerosol-generating article 10, the volatile compounds evolved from the aerosol-forming substrate 20 are drawn downstream through the aerosol-generating article 10 and condense to form an aerosol that is drawn through the mouthpiece 50 of the aerosol-generating article 10 into the user's mouth.

As the aerosol passes downstream thorough the aerosol-cooling element 40, the temperature of the aerosol is reduced due to transfer of thermal energy from the aerosol to the aerosol-cooling element 40. When the aerosol enters the aerosol-cooling element 40, its temperature is approximately 60 degrees Celsius. Due to cooling within the aerosol-cooling element 40, the temperature of the aerosol as it exits the aerosol-cooling element is approximately 40 degrees Celsius.

Although the support element of the aerosol-generating article according to the embodiment described above and illustrated in FIG. 1 is formed from cellulose acetate, it will be appreciated that this is not essential and that aerosol-generating articles according to other embodiments may comprise support elements formed from other suitable materials or combination of materials.

Similarly, although the aerosol-generating article according to the embodiment described above and illustrated in FIG. 1 comprises an aerosol-cooling element comprising a crimped and gathered sheet of polylactic acid, it will be appreciated that this is not essential and that aerosol-generating articles according to other embodiments may comprise other aerosol-cooling elements.

Furthermore, although the aerosol-generating article according to the embodiment described above and illustrated in FIG. 1 has four elements circumscribed by an outer wrapper, it will be appreciated than this is not essential and that aerosol-generating articles according to other embodiments may comprise additional elements or fewer elements.

It will further be appreciated that dimensions provided for elements of the aerosol-generating article according to the embodiment described above and illustrated in FIG. 1 and parts of the aerosol-generating device according to the embodiment described above and illustrated in FIG. 3 are merely exemplary, and that suitable alternative dimensions may be chosen.

Figure 4:
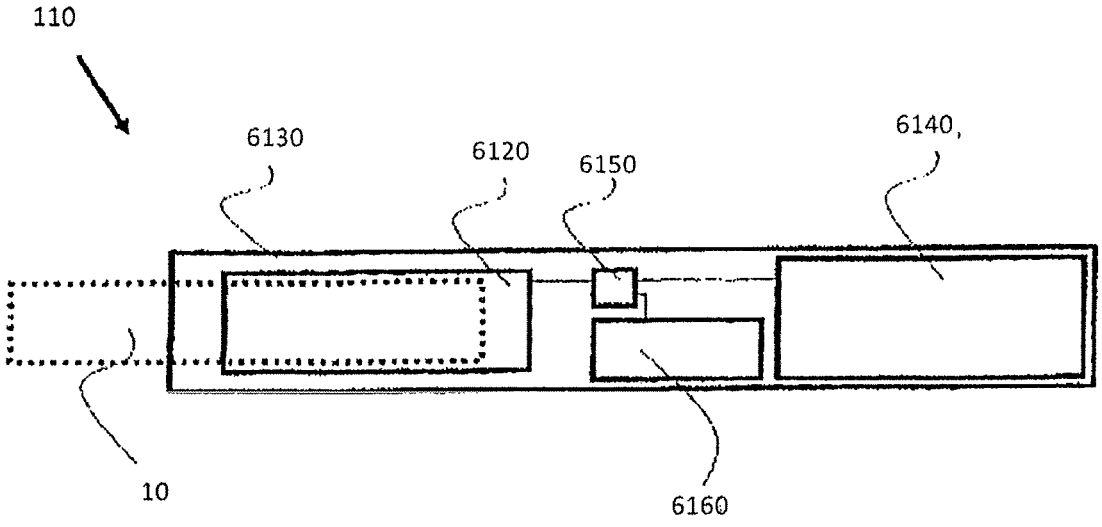
FIG. 4 is a schematic cross-sectional diagram of the aerosol-generating device illustrated in FIG. 3.

In FIG. 4, the components of the aerosol-generating device 110 are shown in a simplified manner. Particularly, the components of the aerosol-generating device 110 are not drawn to scale in FIG. 4. Components that are not relevant for the understanding of the embodiment have been omitted to simplify FIG. 4.

As shown in FIG. 4, the aerosol-generating device 110 comprises a housing 6130. The heating element 6120 is mounted within an aerosol-generating article receiving chamber within the housing 6130. The aerosol-generating article 10 (shown by dashed lines in FIG. 4) is inserted into the aerosol-generating article receiving chamber within the housing 6130 of the aerosol-generating device 110 such that the heating element 6120 is directly inserted into the aerosol-forming substrate 20 of the aerosol-generating article 10.

Within the housing 6130 there is an electrical energy supply 6140, for example a rechargeable lithium ion battery. A controller 6150 is connected to the heating element 6120, the electrical energy supply 6140, and a user interface 6160, for example a button or display. The controller 6150 controls the power supplied to the heating element 6120 in order to regulate its temperature.

The exemplary embodiments described above are not limiting. Other embodiments consistent with the exemplary embodiments described above will be apparent to those skilled in the art.

The invention claimed is:

1. A heated aerosol-generating article having a lowered propensity for flame ignition for use with an aerosol-generating device, the heated aerosol generating article having the lowered propensity for flame ignition comprising:

a plurality of components including an aerosol-forming substrate assembled within a wrapper to form a rod having a mouth end and a distal end upstream from the mouth end, the heated aerosol-generating article having the lowered propensity for flame ignition defining a first air-flow path in which air drawn into the heated aerosol-generating article having the lowered propensity for flame ignition through the mouth end passes through the aerosol-forming substrate, and a second air-flow path in which air drawn into the heated aerosol-generating article having the lowered propensity for flame ignition through the mouth end does not pass through the aerosol-forming substrate, wherein the resistance to draw (RTD) of the second air-flow path is lower than the RTD of the first air-flow path, wherein the RTD of the second air-flow path is less than 10 mm WG, wherein the aerosol-forming substrate comprises an aerosol former at a content of between 5% and 30% on a dry weight basis, and wherein the aerosol-forming substrate has a length of between 7 millimeters and 15 millimeters and wherein the heated aerosol-generating article has a diameter of 7.2 millimeters and a length of 45 millimeters.

2. The heated aerosol-generating article having the lowered propensity for flame ignition according to claim 1, wherein the RTD of the second air-flow path is lower than the RTD of the first air-flow path when the heated aerosol-generating article having the lowered propensity for flame ignition is not coupled to the aerosol-generating device.

3. The heated aerosol-generating article having the lowered propensity for flame ignition according to claim 1, wherein the RTD of the second air-flow path is no more than 0.9 times the RTD of the first air-flow path.

4. The heated aerosol-generating article having the lowered propensity for flame ignition according to claim 1, wherein interaction between the heated aerosol-generating article having the lowered propensity for flame ignition and the aerosol-generating device increases the RTD along the second air-flow path such that air flow is favoured along the first air-flow path.

5. The heated aerosol-generating article having the lowered propensity for flame ignition according to claim 1, wherein the aerosol-forming substrate is located at, or towards, the distal end of the rod, and one or more perforations through the wrapper downstream of the aerosol-forming substrate form part of the second air-flow path.

6. The heated aerosol-generating article having the lowered propensity for flame ignition according to claim 1, wherein the wrapper is a perforated wrapper allowing air to be drawn into the heated aerosol-generating article having the lowered propensity for flame ignition through the wrapper downstream of the aerosol-forming substrate.

7. The heated aerosol-generating article having the lowered propensity for flame ignition according to claim 1, wherein a support element is located downstream of the aerosol-forming substrate, a hole defined through a radial wall of the support element forming part of the second air-flow path.

8. The heated aerosol-generating article according to claim 1, wherein the RTD of the second air-flow path is between 0.2 and 0.7 times the RTD of the first air-flow path.

9. The heated aerosol-generating article according to claim 1, wherein the RTD of the second air-flow path is between 0.3 and 0.5 times the RTD of the first air-flow path.

10. The heated aerosol-generating article according to claim 1, wherein the aerosol former is a polyhydric alcohol.

11. The heated aerosol-generating article according to claim 1, wherein the gathered sheet is a gathered perforated sheet of homogenised tobacco.

* * * * *